US011227536B2

(12) United States Patent
Lin et al.

(10) Patent No.: US 11,227,536 B2
(45) Date of Patent: Jan. 18, 2022

(54) SYSTEMS AND METHODS FOR PERFORMING IN-FRAME CLEANING

(71) Applicant: Apple Inc., Cupertino, CA (US)

(72) Inventors: Xin Lin, Cupertino, CA (US); Yun Wang, Cupertino, CA (US); Chin-Wei Lin, San Jose, CA (US); Majid Gharghi, San Carlos, CA (US); Fan Gui, San Jose, CA (US); Chen-Ming Chen, Taoyuan (TW); Jie Won Ryu, Santa Clara, CA (US); Hyunwoo Nho, Palo Alto, CA (US); Alex H. Pai, Milpitas, CA (US); Kingsuk Brahma, Mountain View, CA (US); Junhua Tan, Saratoga, CA (US); Szu Heng Tseng, Kaohsiung (TW)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/746,325

(22) Filed: Jan. 17, 2020

(65) Prior Publication Data

US 2020/0302856 A1 Sep. 24, 2020

Related U.S. Application Data

(60) Provisional application No. 62/822,468, filed on Mar. 22, 2019.

(51) Int. Cl.

| | |
|---|---|
| ***G09G 3/30*** | (2006.01) |
| ***G09G 3/32*** | (2016.01) |
| ***G09G 3/20*** | (2006.01) |

(52) U.S. Cl.
CPC ..... *G09G 3/32* (2013.01); *G09G 3/2007* (2013.01); *G09G 2300/08* (2013.01); *G09G 2320/0233* (2013.01)

(58) Field of Classification Search
CPC ..... G09G 3/30–3291
See application file for complete search history.

(56) References Cited

U.S. PATENT DOCUMENTS

| | | | | |
|---|---|---|---|---|
| 7,551,164 | B2 | 6/2009 | Deane | |
| 8,305,305 | B2 | 11/2012 | Ono | |
| 10,192,485 | B2 | 1/2019 | He et al. | |
| 2007/0080906 | A1* | 4/2007 | Tanabe | G09G 3/2022 345/76 |

(Continued)

*Primary Examiner* — Roy P Rabindranath
(74) *Attorney, Agent, or Firm* — Fletcher Yoder, P.C.

(57) ABSTRACT

A system includes an electronic display panel that has a plurality of pixels configured to depict frames of image data. The electronic display also includes display driver circuitry configured to, for a first frame of image data representing first image content, modify a gate-to-source voltage of a transistor of a first pixel of the plurality of pixels to a content-dependent first gate-to-source voltage. Additionally, after modifying the gate-to-source voltage to the first gate-to-source voltage, the display driver circuitry is configured to program the first pixel by modifying the gate-to-source voltage to a gate-to-source programming voltage that differs from the first gate-to-source voltage and is based on image data associated with the pixel from the first frame of the image data. Furthermore, the display driver circuitry is configured to cause the plurality of pixels to emit light.

20 Claims, 12 Drawing Sheets

(56) References Cited

U.S. PATENT DOCUMENTS

| | | | | |
|---|---|---|---|---|
| 2015/0070339 | A1* | 3/2015 | Ahn | G09G 3/3233<br>345/211 |
| 2019/0073955 | A1* | 3/2019 | Zou | G09G 3/3233 |
| 2020/0058250 | A1* | 2/2020 | Dong | G09G 3/3275 |

* cited by examiner

SYSTEMS AND METHODS FOR PERFORMING IN-FRAME CLEANING

CROSS-REFERENCE TO RELATED APPLICATIONS

This application claims priority to U.S. Provisional Patent Application No. 62/822,468, entitled "SYSTEMS AND METHODS FOR PERFORMING IN-FRAME CLEANING," filed on Mar. 22, 2019, which is incorporated herein by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to reducing and/or eliminating visible changes in luminance that may occur when content (e.g., a still image) is displayed on a display for extended periods of time (e.g., minutes, hours, days). As described below, in one embodiment, an in-frame cleaning technique may be utilized to keep a threshold voltage associated with a transistor of display circuitry (e.g., a pixel of a display) from changing or to slow the change in threshold voltage that may occur when content is shown for extended periods of time. In particular, a content-dependent voltage (e.g., gate-to-source voltage) may be applied to the transistor before being programmed, which may alter a voltage associated with the transistor and slow down or eliminate the accumulation of charge in the transistor that may otherwise occur. Charge accumulation in the transistor over time as content (e.g., frames of video content, still images, etc.) is shown may cause the threshold voltage associated with the transistor to change, which in some cases, may cause visible changes to the content displayed (e.g., change in luminance, perceived change in coloration of content). Accordingly, by modifying the gate-to-source voltage of the transistor before programming (and/or after a previous emission of light from a light emitting diode (LED) associated with the transistor), charge accumulation may be reduced and/or eliminated, which may reduce the occurrence of display irregularities attributable to changes in threshold voltage of the transistor.

Furthermore, in-frame cleaning may also be utilized to reduce "image sticking," which refers to an image or portion of an image persisting, or still being displayed, longer than the image or portion thereof should be displayed. For example, content from one frame of content may still be visible to the human eye after a subsequent frame of content is displayed. As discussed below, performing in-frame cleaning may accelerate the recovery from a shift in threshold voltage. For example, a gap in threshold voltage between a first threshold voltage associated with relatively high gray-levels (e.g., relatively brighter content) and content relatively low gray-levels (e.g., relatively darker content) may cause image sticking. By shortening the time it takes to reduce the gap in threshold voltage, the occurrence of image sticking perceivable by the human eye may be reduced and/or eliminated.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
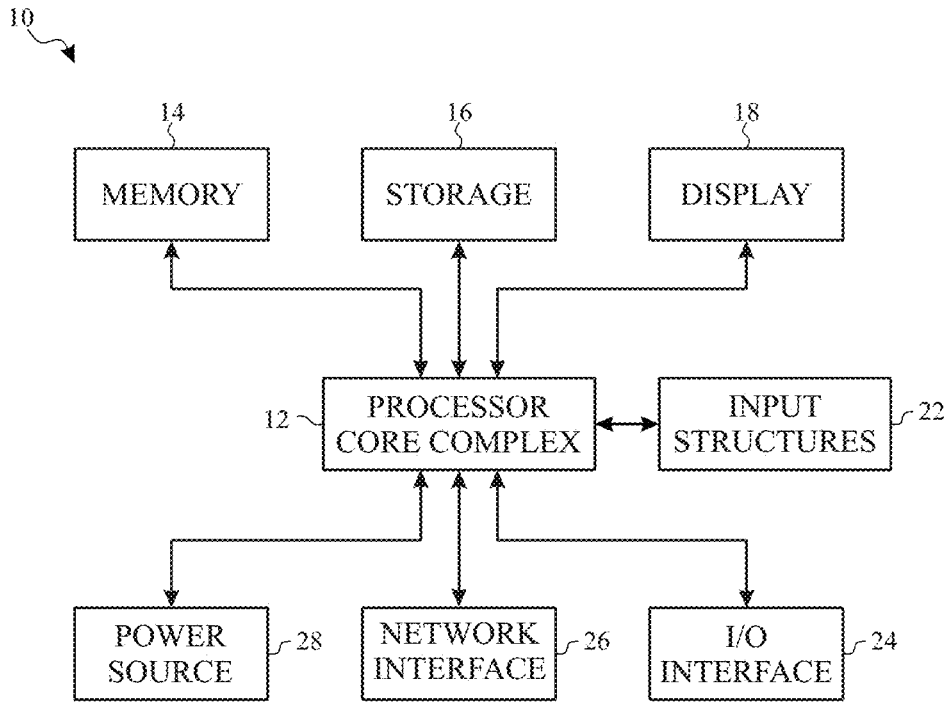
FIG. 1 is a schematic block diagram of an electronic device, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions are made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment"

or "an embodiment" of the present disclosure are not intended to be interpreted as excluding the existence of additional embodiments that also incorporate the recited features.

Electronic displays are found in numerous electronic devices, from mobile phones to computers, televisions, automobile dashboards, and many more. Individual pixels of the electronic display may collectively produce images by permitting different amounts of light to be emitted from each pixel. This may occur by self-emission as in the case of light-emitting diodes (LEDs), such as organic light-emitting diodes (OLEDs), or by selectively providing light from another light source as in the case of a digital micromirror device or liquid crystal display. In some cases, image data represented by an output of a display may change due to changes in pixel operation over time. For example, when an image (e.g., a static image) is displayed for relatively longer periods of time (e.g., minutes, hours, days) the appearance of the image may change over time. Additionally, image sticking may occur, for example, when a transition from an image or piece of content that was displayed for a relatively long time (e.g., minutes or hours or longer) to another image occurs. For instance, when switching from relatively high-contrast content (e.g., content associated with relatively a high gray-level difference) to relatively low-contrast content (e.g., content associated with a relatively low gray-level difference), portions of the relatively high-contrast content may persist on the display and be visible to the human eye.

Embodiments of the present disclosure relate to reducing and/or eliminating visible changes in luminance that may occur when content (e.g., a still image) is displayed on a display for extended periods of time (e.g., minutes, hours, days). As described below, in one embodiment, an in-frame cleaning technique may be utilized to keep a threshold voltage associated with a transistor of display circuitry (e.g., a pixel of a display) from changing or to slow the change in threshold voltage that may occur when content is shown for extended periods of time. In particular, a content-dependent voltage (e.g., gate-to-source voltage) may be applied to the transistor before being programmed, which may alter a voltage associated with the transistor and slow down or eliminate the accumulation of charge in the transistor that may otherwise occur. Charge accumulation in the transistor over time as content (e.g., frames of video content, still images, etc.) is shown may cause the threshold voltage associated with the transistor to change, which in some cases, may cause visible changes to the content displayed (e.g., change in luminance, perceived change in coloration of content). For instance, a gap in threshold voltage associated with relatively high gray-levels and threshold voltage associated with relatively low gray-levels may increase over time when content is shown for a relatively long period of time (e.g., minutes, hours, days). Accordingly, by modifying the gate-to-source voltage of the transistor before programming (and after a previous emission of light from a light emitting diode (LED) associated with the transistor), charge accumulation may be reduced and/or eliminated, and the growth of a difference between threshold voltage associated with relatively high gray-levels and threshold voltage associated with relatively low gray-levels may be decelerated, which may reduce the occurrence of display irregularities attributable to changes in threshold voltage of the transistor. Furthermore, by performing in-frame cleaning, when shifting from content displayed for a relatively long time (e.g., minutes, hours, days) to other content, decreasing a difference between threshold voltage associated with relatively high gray-levels and threshold voltage associated with relatively low gray-levels may be accelerated, which may reduce and/or eliminate the occurrence of image sticking.

Figure 2:
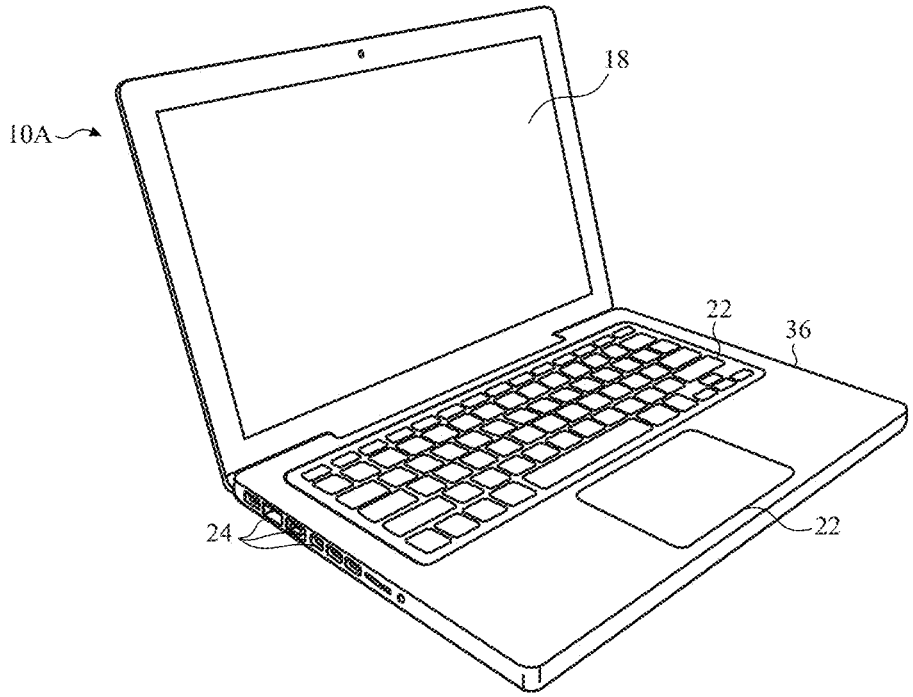
FIG. 2 is a perspective view of a notebook computer representing an embodiment of the electronic device of FIG. 1.
Figure 4:
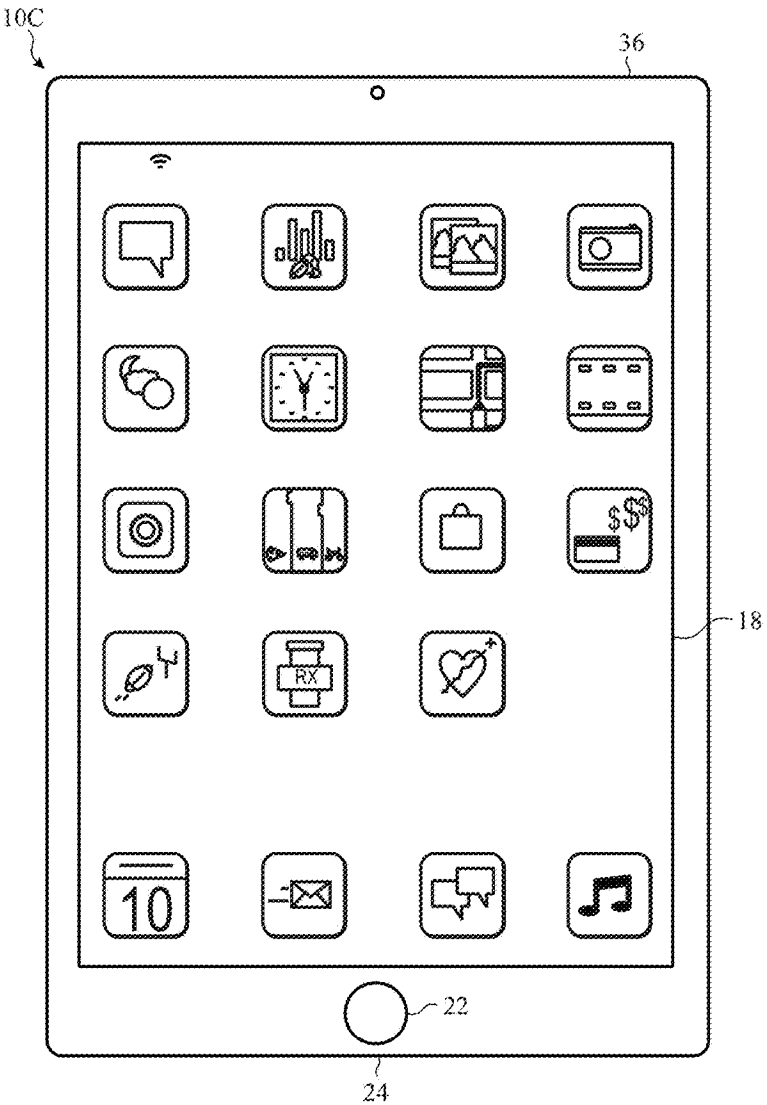
FIG. 4 is a front view of another hand-held device representing another embodiment of the electronic device of FIG. 1.
Figure 3:
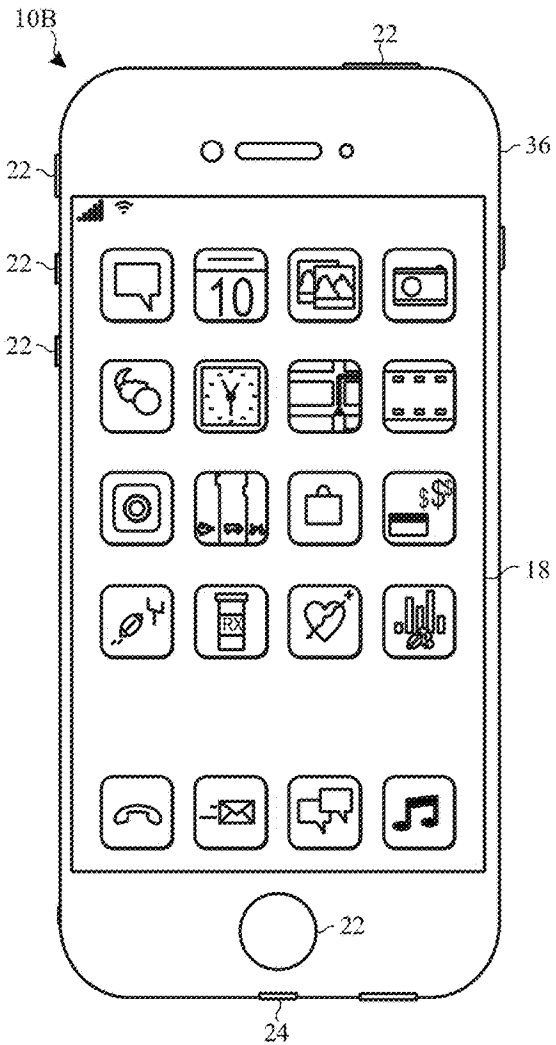
FIG. 3 is a front view of a hand-held device representing another embodiment of the electronic device of FIG. 1.
Figure 5:
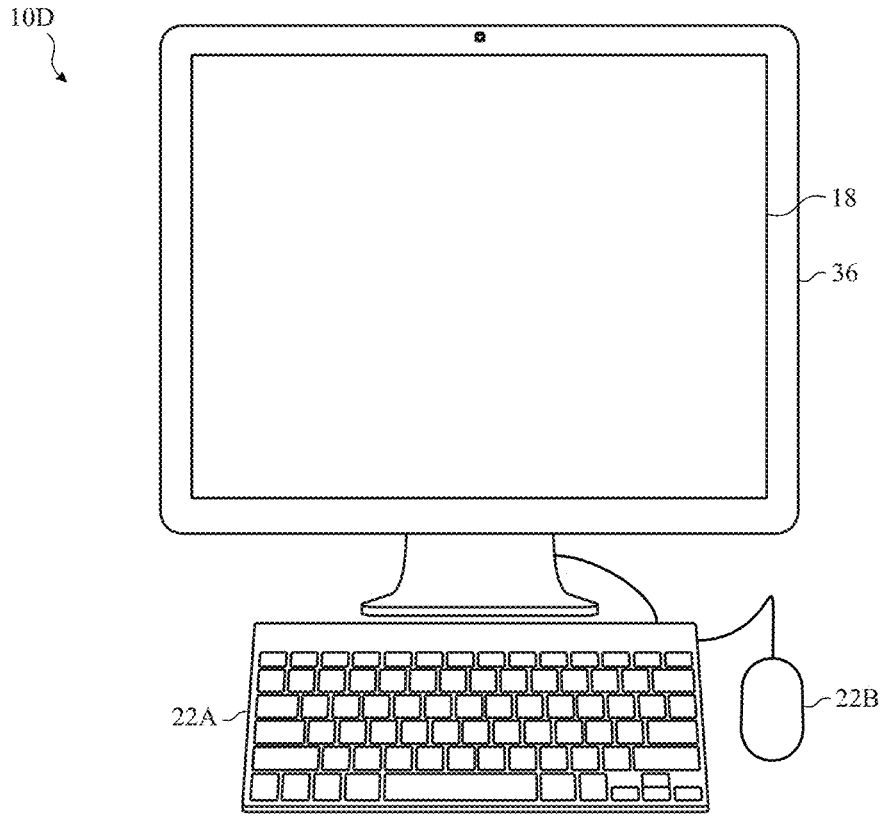
FIG. 5 is a front view of a desktop computer representing another embodiment of the electronic device of FIG. 1.
Figure 6:
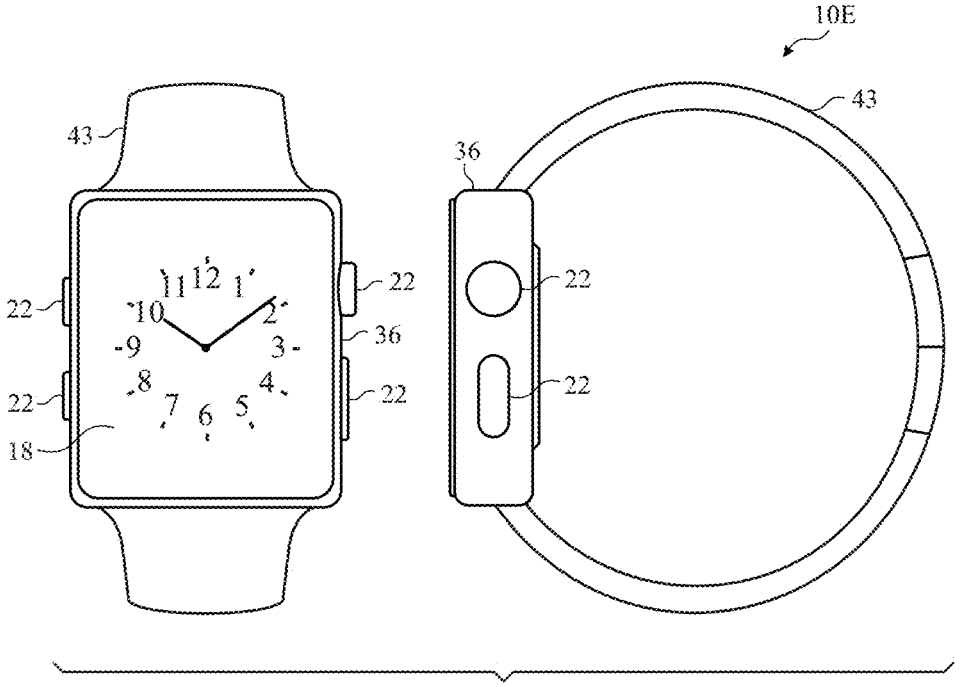
FIG. 6 is a front view and side view of a wearable electronic device representing another embodiment of the electronic device of FIG. 1.

A general description of suitable electronic devices that may perform the in-frame cleaning technique described herein and display images through emission of light from light-emitting components, such as an LED (e.g., an OLED) display, and corresponding circuitry are provided in this disclosure. It should be understood that a variety of electronic devices, electronic displays, and electronic display technologies may be used to implement the techniques described herein. With this in mind, a block diagram of an electronic device 10 is shown in FIG. 1. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or a similar device.

The electronic device 10 shown in FIG. 1 may include, for example, a processor core complex 12, a local memory 14, a main memory storage device 16, an electronic display 18, input structures 22, an input/output (I/O) interface 24, network interfaces 26, and a power source 28. The various functional blocks shown in FIG. 1 may include hardware elements (including circuitry), software elements (including machine-executable instructions stored on a tangible, non-transitory medium, such as the local memory 14 or the main memory storage device 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage device 16 may be included in a single component.

The processor core complex 12 may carry out a variety of operations of the electronic device 10, such as provide image data for display on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage device 16. In addition to instructions for the processor core complex 12, the local memory 14 and/or the main memory storage device 16 may also store data to be processed by the processor core complex 12. By way of example, the local memory 14 may include random access memory (RAM) and the main memory storage device 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diodes (OLED) display, or may be a liquid crystal display (LCD) illuminated by a backlight. In some embodiments, the electronic display 18 may include a touch screen, which may allow users to interact with a user interface of the electronic device 10. The electronic display 18 may employ display panel sensing to identify operational variations of the electronic display 18. This may allow the processor core complex 12 or the electronic display 18 to adjust image data that is sent to the electronic display 18 to compensate for these variations, thereby improving the quality of the image frames appearing on the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra wideband (UWB), alternating current (AC) power lines, and so forth. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on the electronic display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal serial bus (USB), or other similar connector and protocol.

User input structures 22, in combination with the electronic display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as input structures 22A or 22B (e.g., keyboard and mouse), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
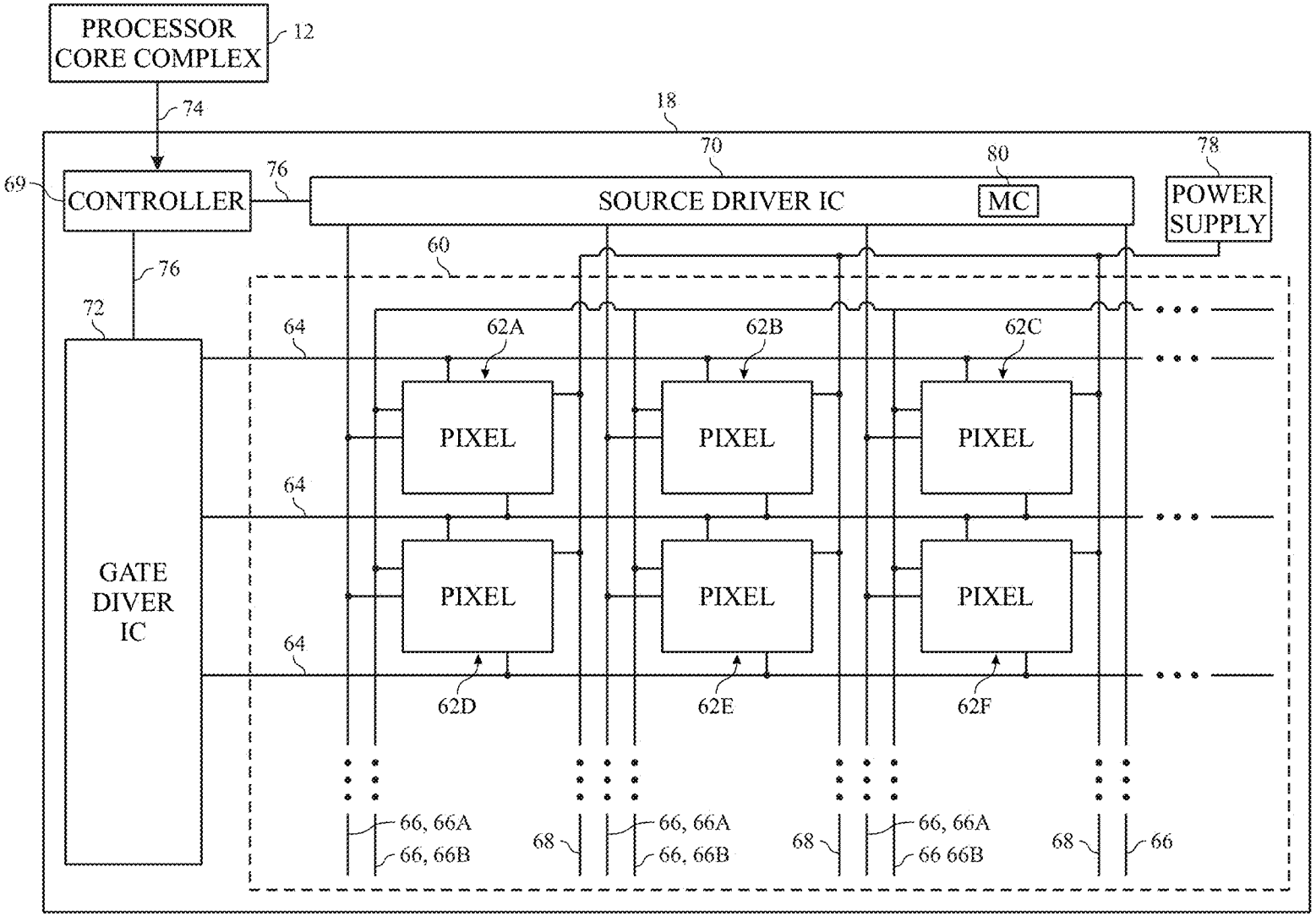
FIG. 7 is a circuit diagram illustrating a portion of an array of pixels of the display of FIG. 1, in accordance with an embodiment.

The electronic display 18 for the electronic device 10 may include a matrix of pixels that contain light-emitting circuitry. Accordingly, FIG. 7 illustrates a circuit diagram including a portion of a matrix of pixels in an active area of the electronic display 18. As illustrated, the electronic display 18 may include a display panel 60. Moreover, the display panel 60 may include multiple unit pixels 62 (here, six unit pixels 62A, 62B, 62C, 62D, 62E, and 62F are shown) arranged as an array or matrix defining multiple rows and columns of the unit pixels 62 that collectively form a viewable region of the electronic display 18, in which an image may be displayed. In such an array, each unit pixel 62 may be defined by the intersection of rows and columns, represented here by the illustrated gate lines 64 (also referred to as "scanning lines") and data lines 66 (also referred to as "source lines"), respectively. Additionally, power supply lines 68 may provide power to each of the unit pixels 62 (e.g., from power supply 78). The unit pixels 62 may include, for example, a thin film transistor (TFT) coupled to a self-emissive pixel, such as an OLED, whereby the TFT may be a driving TFT that facilitates control of the luminance of a display pixel 62 by controlling a magnitude of supply current flowing into the OLED of the display pixel 62 or a TFT that controls luminance of a display pixel by controlling the operation of a liquid crystal.

Although only six unit pixels 62, referred to individually by reference numbers 62A-62F, respectively, are shown, it should be understood that in an actual implementation, each data line 66 and gate line 64 may include hundreds or even thousands of such unit pixels 62. By way of example, in a color display panel 60 having a display resolution of 1024×768, each data line 66, which may define a column of the pixel array, may include 768 unit pixels, while each gate line 64, which may define a row of the pixel array, may include 1024 groups of unit pixels with each group including a red, blue, and green pixel, thus totaling 3072 unit pixels per gate line 64. It should be readily understood, however, that each row or column of the pixel array any suitable number of unit pixels, which could include many more pixels than 1024 or 768. In the presently illustrated example, the unit pixels 62 may represent a group of pixels having a red pixel (62A), a blue pixel (62B), and a green pixel (62C). The group of unit pixels 62D, 62E, and 62F may be arranged in a similar manner. Additionally, in the industry, it is also common for the term "pixel" may refer to a group of adjacent different-colored pixels (e.g., a red pixel, blue pixel, and green pixel), with each of the individual colored pixels in the group being referred to as a "sub-pixel." In some cases, however, the term "pixel" refers generally to each sub-pixel depending on the context of the use of this term.

As illustrated, the electronic display 18 may include an array of pixels 62 (e.g., self-emissive pixels). The electronic display may include any suitable circuitry to drive the pixels 62. In the example of FIG. 7, the electronic display 18 includes a controller 69, a source driver integrated circuit (IC) 70, and a gate driver IC 72. The source driver IC 70 and gate driver IC 72 may drive individual of the self-emissive pixels 62. In some embodiments, the source driver IC 70 and the gate driver IC 72 may include multiple channels for independently driving multiple of the self-emissive pixel 62. Each of the pixels 62 may include any suitable light-emitting element, such as a LED, one example of which is an OLED. However, any other suitable type of pixel, including non-self-emissive pixels (e.g., liquid crystal, digital micromirror) may also be utilized.

The controller 69, which may include a chip, such as a processor or application specific integrated circuit (ASIC), that controls various aspects (e.g., operation) of the electronic display 18 and/or the display panel 60. For instance, the controller 69 may receive image data 74 from the processor core complex indicative of light intensities for the light outputs for the pixels 62. In some embodiments, the controller 69 may be coupled to the local memory 14 and retrieve the image data 74 from the local memory 14. The controller 69 may control the pixels 62 by using control signals to control elements of the pixels 62. For instance, the pixels 62 may include any suitable controllable element, such as a transistor, one example of which is a MOSFET. The pixels 62, which may be self-emissive, may include any suitable controllable element, such as a transistor, one example of which is a MOSFET. However, any other suitable type of controllable elements, including thin film transistors (TFTs), p-type and/or n-type MOSFETs, and other transistor types, may also be used. The controller 69 may control elements of the pixels 62 via the source driver IC70 and the gate driver IC 72. For example, the controller 69 may send signals to the source driver IC 70, which may send signals (e.g., timing information/image signals 76) to the pixels 62. The gate driver IC 72 may provide/remove gate activation signals to activate/deactivate rows of unit pixels 62 via the gate lines 64 based on timing information/image signals 76 received from the controller 69.

In some embodiments, the controller 69 may be included in the source driver IC 70. Additionally, the controller 69 or source driver IC 70 may include a timing controller (TCON) that determines and sends the timing information/image signals 76 to the gate driver IC 72 to facilitate activation and deactivation of individual rows of unit pixels 62. In other embodiments, timing information may be provided to the gate driver IC 72 in some other manner (e.g., using a controller 80 that is separate from or integrated within the source driver IC 70). Further, while FIG. 7 depicts only a controller 69 and a single source driver IC 70, it should be appreciated that other embodiments may utilize multiple controllers 69 and/or multiple source driver ICs 70 to provide timing information/image signals 76 to the unit pixels 62. For example, additional embodiments may include multiple controller 69 and/or multiple source driver ICs 70 disposed along one or more edges of the display panel 60, with each controller 69 and/or source driver IC 70 being configured to control a subset of the data lines 66 and/or gate lines 64.

Figure 8:
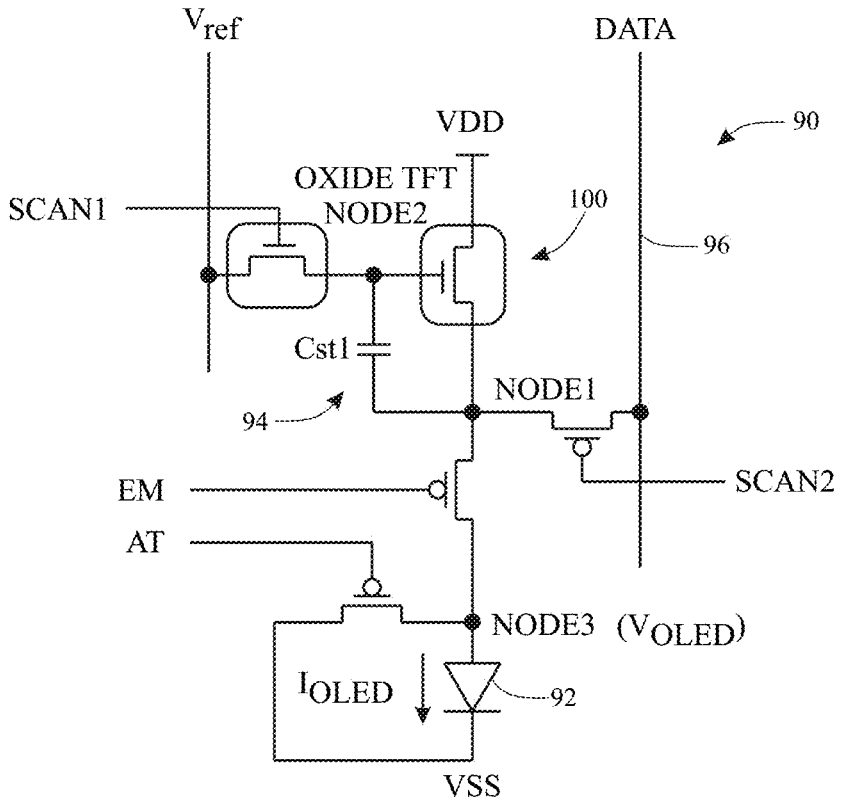
FIG. 8 is a circuit diagram of an example pixel driving circuit for a pixel in the display of the electronic device of FIG. 1, in accordance with an embodiment.

In some embodiments, the pixel 62 may include a number of circuit components to enable the respective LED to produce light for a prescribed amount of time or produce a particular gray level. By way of example, FIG. 8 illustrates a pixel driving circuit 90 that may include a number of semiconductor devices that may coordinate the transmission of data signals to an organic light-emitting diode (LED) 92 of a respective pixel 62. In one embodiment, the pixel driving circuit 90 may receive input signals (e.g., emission signals 1 and 2, scan signals 1 and 2), which may be coordinated in a manner to cause the pixel driving circuit 90 to display image data and transmit a test data signal used to determine the OLED voltage (VoLED) (e.g., voltage at Node 3) of the OLED 92.

With this in mind, the pixel driving circuit 90 may include, in one embodiment, N-type semiconductor devices and P-type semiconductor devices, as shown in FIG. 8. Although the following description of the pixel driving circuit 90 is illustrated with the N-type semiconductor devices and the P-type semiconductor devices, it should be noted that the pixel driving circuit 90 may be designed using any suitable combination of N-type or P-type semiconductor devices.

In addition to the semiconductor devices, the pixel driving circuit 90 may include a capacitor 94 that may store data provided via data line 96. The close proximity between the various circuit components of the pixel driving circuit 90 and the various voltage sources (e.g., VDD, VSS) may also create parasitic capacitance within the pixel driving circuit 90. The capacitor 94 and the parasitic capacitance of the pixel driving circuit 90 may be combined in a capacitance ratio that represents the total capacitance of the pixel driving circuit 90.

In some embodiments, one or more of the semiconductors (e.g., TFTs) of the pixel driving circuit 90 may produce a current in response to the voltage received via the data line 96. When the emission signal (e.g., EM) is provided to a gate of the respective switch, the OLED 92 may receive a current that corresponds to the data stored in the capacitor 94. As the OLED 92 illuminates in response to receiving the current ($I_{OLED}$), a voltage (e.g., $V_{OLED}$) at Node 3 may change when the OLED 92 receives the same amount of current over time. This change in voltage is representative of the aging effects of the OLED 92.

In some cases, the appearance of images displayed via the electronic display 18 may change over time due to a threshold voltage of a transistor changing over time. In other words, the minimum gate-to-source voltage sufficient to form a conducting path between source and drain terminals of the transistor may change over time. For example, a threshold voltage of a transistor 100 of the pixel driving circuit 90 may change over time when the same image data is presented via the electronic display 18 for extended periods of time (e.g., minutes, hours, days). Such a shift in threshold voltage may cause changes in the content that is shown via the electronic display 18. That is, the pixel driving circuit 90 may emit light with different characteristics as a result of the threshold voltage changing. For example, pixels emitting light associated with relatively low gray-levels that would normally appear dark, may appear brighter over time. Conversely, relatively high gray-levels that would normally appear relatively bright may darken over time.

Figure 9:
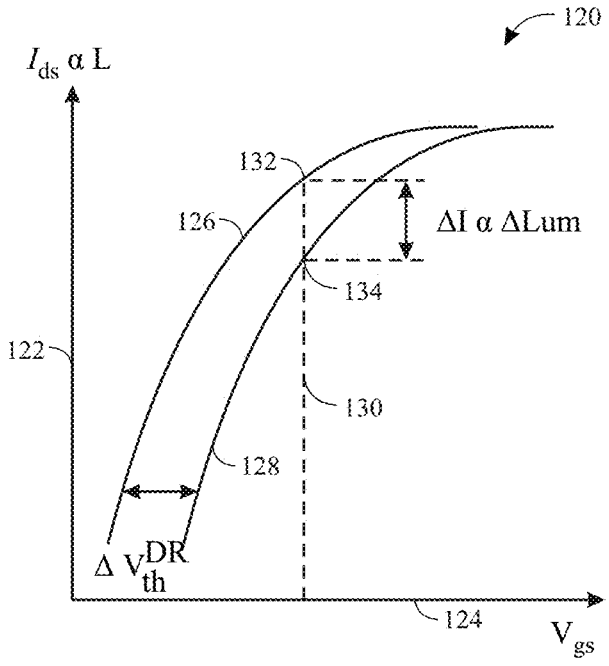
FIG. 9 is a graph illustrating drain-to-source current versus gate-to-source voltage of a transistor of the pixel driving circuit of FIG. 8, in accordance with an embodiment.

To help illustrate this, FIG. 9 is a graph 120 illustrating drain-to-source current (represented by axis 122) versus gate-to-source voltage (represented by axis 124). It should be noted that the drain-to-source current is proportional to the luminance ("L") associated with the pixel driving circuit 90. The graph 120 also includes a first curve 126 and a second curve 128. The curves 126, 128 are representative of a pixel's operation at two different points in time. For example, the first curve 126 may be associated with the pixel driving circuit 90 at a first time, and the second curve 128 may be associated with the pixel driving circuit 90 at a second, later time. As illustrated, the second curve 128 is generally shifted to the right compared to the first curve. As such, a threshold voltage may be associated with a relatively higher luminance on the first curve 126 compared to the second curve 128. For example, line 130 shows a threshold voltage (e.g., gate-to-source voltage) associated with one luminance (e.g., luminance associated with point 132) on the first curve 126, while on the second curve 128, the same voltage may be associated with a lower luminance (e.g., a luminance associated with point 134). In other words, the graph 120 illustrates that when there is a change or shift in threshold voltage, the luminance level associated with the threshold voltage may also change.

Figure 10:
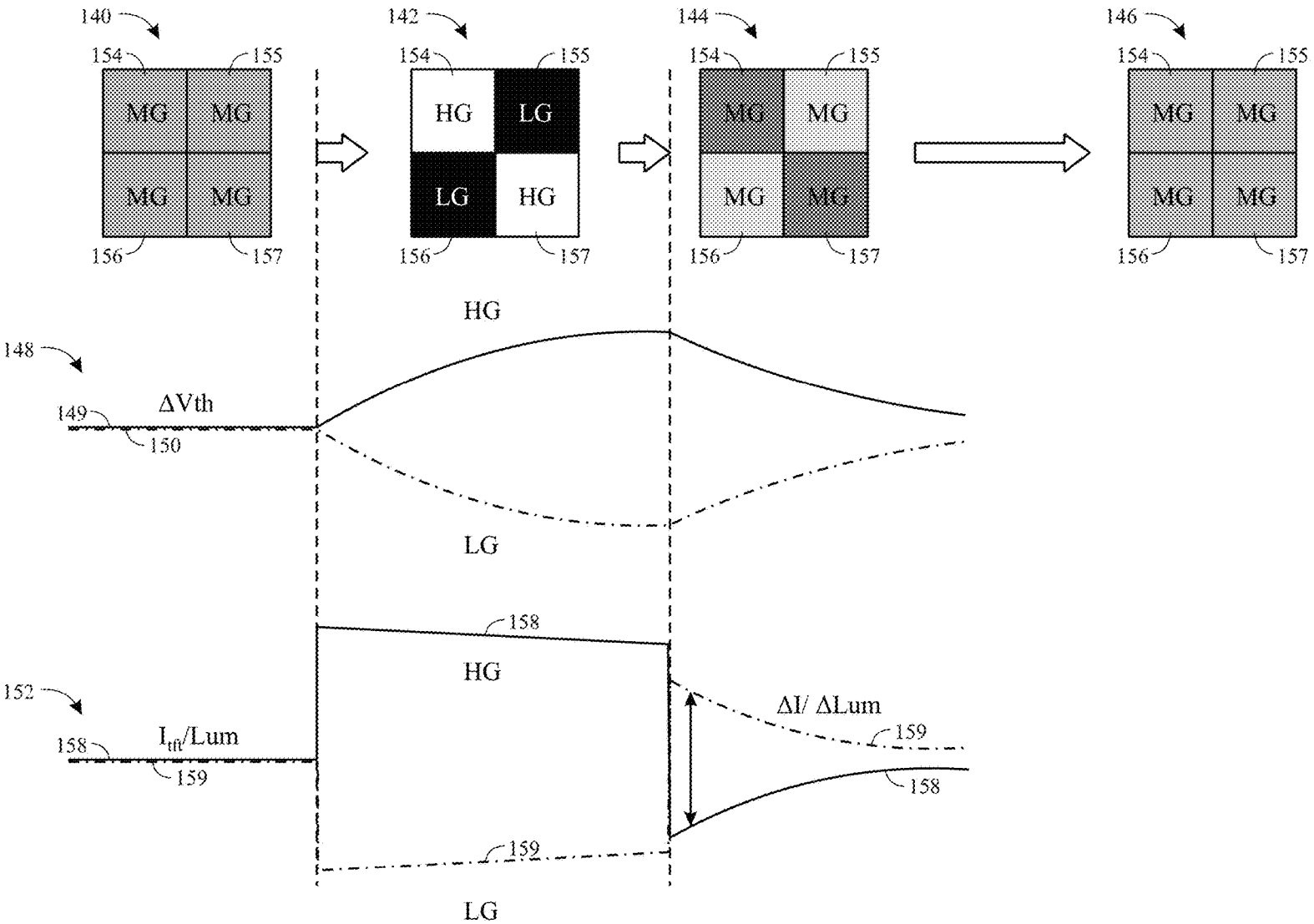
FIG. 10 illustrates changes in threshold voltage and luminance associated with different content associated with transitions of content, in accordance with an embodiment.

As discussed above, there may be a gap in threshold voltage associated with different pixels included in display circuitry, especially when there is a contrast in the content being displayed by the pixels. Bearing this in mind, FIG. 10 illustrates a transition from a first piece of content 140 to second piece of content 142 to a third piece of content 144 to a fourth piece of content 146. FIG. 10 also includes graph 148, which illustrates a threshold voltage of transistors (e.g., transistor 100) for one or more pixels (e.g., pixels 62 of the display panel 60) displaying content at a relatively higher gray-level (represented by line 149) and a threshold voltage for one or more pixels displaying content at a relatively lower gray-level (represented by line 150), and graph 152, which is representative of current associated with transistors (e.g., transistor 100) in pixels included in display circuitry (e.g., pixels 62 of the display panel 60) or luminance associated with the pixels. More specifically, each of the pieces of content 140, 142, 144, 146 pertain to content associated with four pixels: a first pixel 154, a second pixel 155, a third pixel 156, and a fourth pixel 157.

In the first frame of content 140, the pixels 154, 155, 156, 157 may each be associated with a median gray-level "MG." Because each of the pixels 154, 155, 156, 157 is associated with the same gray level, a threshold voltage associated with a transistor (e.g., transistor 100) of each of the pixels 154, 155, 156, 157 may be equal or substantially equal, as shown by the lines 149, 150 in the graph 148. Furthermore, current associated with the transistor (e.g., transistor 100) of each of the pixels 154, 155, 156, 157 and luminance associated with the pixels 154, 155, 156, 157 may be equal or substantially equal, as represented by line 158 and line 159 of graph 152.

A transition to the second frame of content 142 may occur. As illustrated, in the second frame of content 142, each of the pixels 154, 155, 156, 157 may be associated with a gray-level that differs from a corresponding gray-level of the first frame of content 140. For example, in the second frame of content 142, the first pixel 154 and fourth pixel 157 are both associated with a relatively high gray-level "HG" (e.g., G255), while the second pixel 155 and third pixel 156 are both associated with a relatively low gray-level "LG" (e.g., G0).

Threshold voltages associated with transistors (e.g., transistor 100) in the pixels 154, 155, 156, 157 are shown in the graph 148. In particular, line 149 may correspond to the first pixel 154 and the fourth pixel 157, and line 150 may correspond to the second pixel 155 and the third pixel 156. As illustrated in the graph 148, a gap in threshold voltage may occur, and the gap may grow over time. For instance, a display (e.g., display 18) that includes the pixels 154, 155, 156, 157 may display many frames of content that are equivalent to the second frame of content 142 over an extended period of time (e.g., minutes, hours, days), during which time the gap between the threshold voltages indicated by the lines 149, 150 may grow.

The changes in luminance associated with the transition from the first frame of content 140 to the second frame of content 142 are reflected in the graph 152. For example, line 158 corresponds to the first pixel 154 and the fourth pixel 157, while the line 159 corresponds to the second pixel 155 and the third pixel 156. As illustrated, as the luminance associated with the pixels 154, 155, 156, 157 (and the current associated with transistors of the pixels 154, 155, 156, 157) may change as the threshold voltage changes. For example, as a threshold voltage associated with the first pixel 154 and the fourth pixel 157 increases, the luminance of the first pixel 154 and fourth pixel 157 may decrease. Conversely, as a threshold voltage associated with the second pixel 155 and the third pixel 156 decreases, the luminance of the second pixel 155 and third pixel 156 may increase. In other words, as the gap in threshold voltage increases, a gap in luminance between the relatively higher luminance and the relatively lower luminance may decrease.

At another point in time, the pixels 154, 155, 156, 157 may be commanded to display image data associated with the median gray-level, and the third frame of content 144 may be displayed. However, as illustrated in FIG. 10, the displayed content associated with the pixels 154, 155, 156, 157 may differ from the content shown during the first frame of content 142 even though both the pixels 154, 155, 156, 157 are associated with the same gray-levels during the first frame of content 140 and the third frame of content 144. Such a phenomenon may be perceived to the human eye as image sticking. In particular, the difference between the displayed content of the pixels 154, 155, 156, 157 during the third frame of content 144 compared to the first frame of content 140 is attributable to the accumulation of the shift in threshold voltage that occurred during a time associated with the second frame of content. In other words (and as illustrated by the graph 148), to show the median gray-level content, the gap in threshold voltage between the lines 149, 150 will decrease. However, until the gap in threshold voltage shrinks to a sufficient level, while the gap in threshold voltage is decreasing, the luminance associated with each of the pixels 154, 155, 156, 157 may not match the luminance that the pixels 154, 155, 156, 157 were commanded to have. When the gap in threshold voltage decreases, the displayed content may correspond to the gray-levels that the pixels 154, 155, 156, 157 were commanded to have. For example, the fourth frame of content 146, which has the same gray-levels as the third frame of content 146, may correspond to a time when the gap in threshold voltage has been sufficiently reduced and/or eliminated.

Keeping the discussion of FIG. 9 and FIG. 10 in mind, the present disclosure relates to techniques that reduce shifts or gaps in threshold voltage associated with pixel circuitry (e.g., while content is shown for an extended period of time, such as minutes, hours, days, or longer), such as the pixel driving circuit 90. Additionally, the presently disclosed techniques may accelerate reducing a gap in threshold voltage when transitioning between different content. In particular, the present application relates to a technique referred herein as "in-frame cleaning," which, as discussed below, is generally performed by performing operations that change a gate-to-source voltage associated with a transistor prior to programming the pixel circuitry. For instance, the presently disclosed techniques may be performed using the circuitry illustrated in FIG. 5 and FIG. 8. More specifically, the gate-to-source voltage may by associated with a gate (e.g., NODE2) and source (e.g., NODE1) of the transistor 100 of FIG. 8, which may be an oxide thin film transistor. Furthermore, as discussed below, the gate-to-source voltage may become a value that is dependent upon image data (e.g., a gray-level) associated with the pixel.

Figure 11:
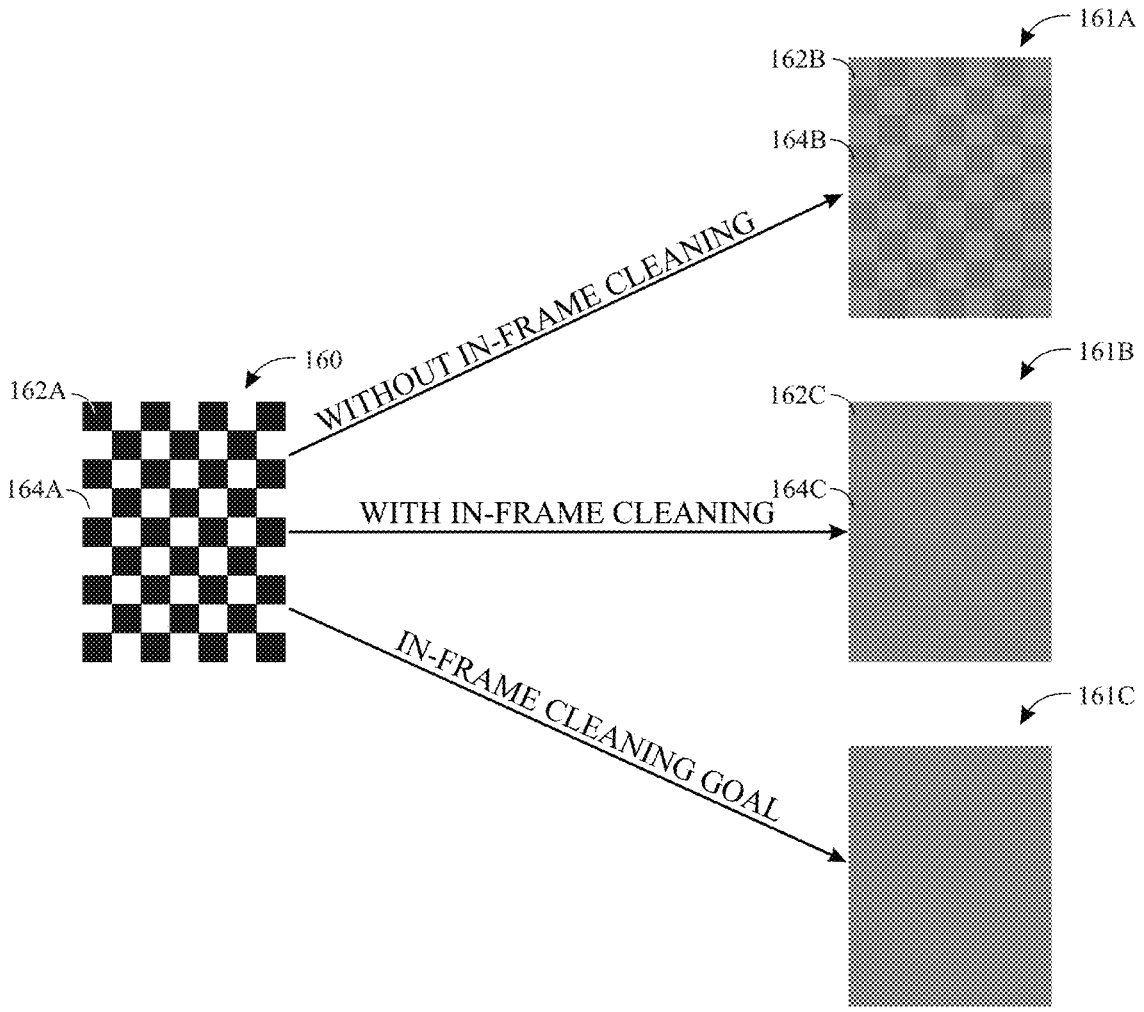
FIG. 11 illustrates the appearance of image content that is displayed after different image content has been presented for an extended period of time when in-frame cleaning is performed and when in-frame cleaning is not performed, in accordance with an embodiment.

Continuing with the drawings, FIG. 11 illustrates the appearance of image content 160 as well as how a different image content 161 appears when in-frame cleaning is performed and when in-frame cleaning is not performed. In particular, the image content 160 generally corresponds to the second frame of content 142 of FIG. 10, and the image content 161 generally corresponds to third frame of content 144 of FIG. 10. In other words, the image content 160 may be displayed via the electronic display 18 of the electronic device 10 at a first time. As illustrated, the image content 160 includes light regions (e.g., region 162) and dark regions (e.g., region 164). The region 162 may be associated with a relatively high gray-level, whereas the region 164 may be associated with a relatively low gray-level. At a second time, the pixels of the electronic display 18 may be commanded (e.g., via the controller 69) to display different content, such as image content associated with a median gray-level.

Without in-frame cleaning, the image content 161A may be presented via the electronic display 18. As illustrated, the regions 162B and regions 164B may still be perceivable in the form of image sticking. In other words, as respectively shown by region 162B and the region 164B, remnants of the region 162A and region 164A perceivable to the human eye may still persist on the electronic display 18 while other content is displayed. Conversely, as illustrated by the image content 161B, when in-frame cleaning is performed, image sticking may be less perceptible or not occur. For example, the region 162C and region 164C may be much less perceptible respectively compared to the region 164A and region 164B, and, in some embodiments, the region 162C and region 164C may not be visible. For instance, in embodiments in which the image content 160 is lower in contrast (e.g., associated with a smaller gray-level difference between the region 162A and the region 164A), the image content 161B may appear uniform to the human eye. In other words, a gray-level associated with the region 162C may be equal to a gray-level associated with the region 164C, or a difference between the gray-level associated with the region 162C and the gray-level associated with the region 164C may not be perceptible to the human eye.

Also illustrated in the FIG. 11 is image content 161C, which is representative of an in-frame cleaning goal. As illustrated, the image content 161C is uniformly gray-level. In other words, while the image content 161C may include regions (e.g., regions 162), because each region has the same color, to the human eye, the regions are indistinguishable from one another. As mentioned above, image content such as the image content 161C may be achieved when there is smaller difference in gray-level contrast between the regions 162 in image content that precedes the image content 161C. For instance, in embodiments of the image content 160 in which the image content 160 is lower in contrast, the image content 161C may displayed.

Figure 12:
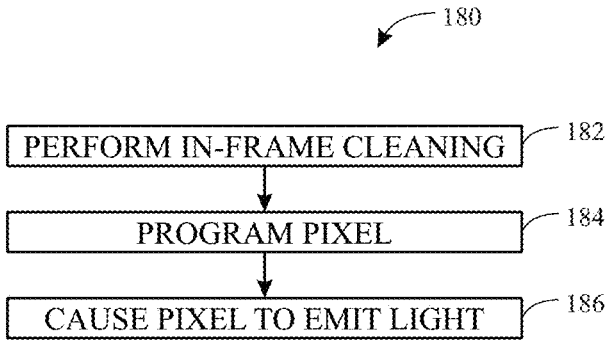
FIG. 12 is flow diagram of a process for operating pixel circuitry, such as the pixel driving circuitry of FIG. 8, in accordance with an embodiment.
Figure 13:
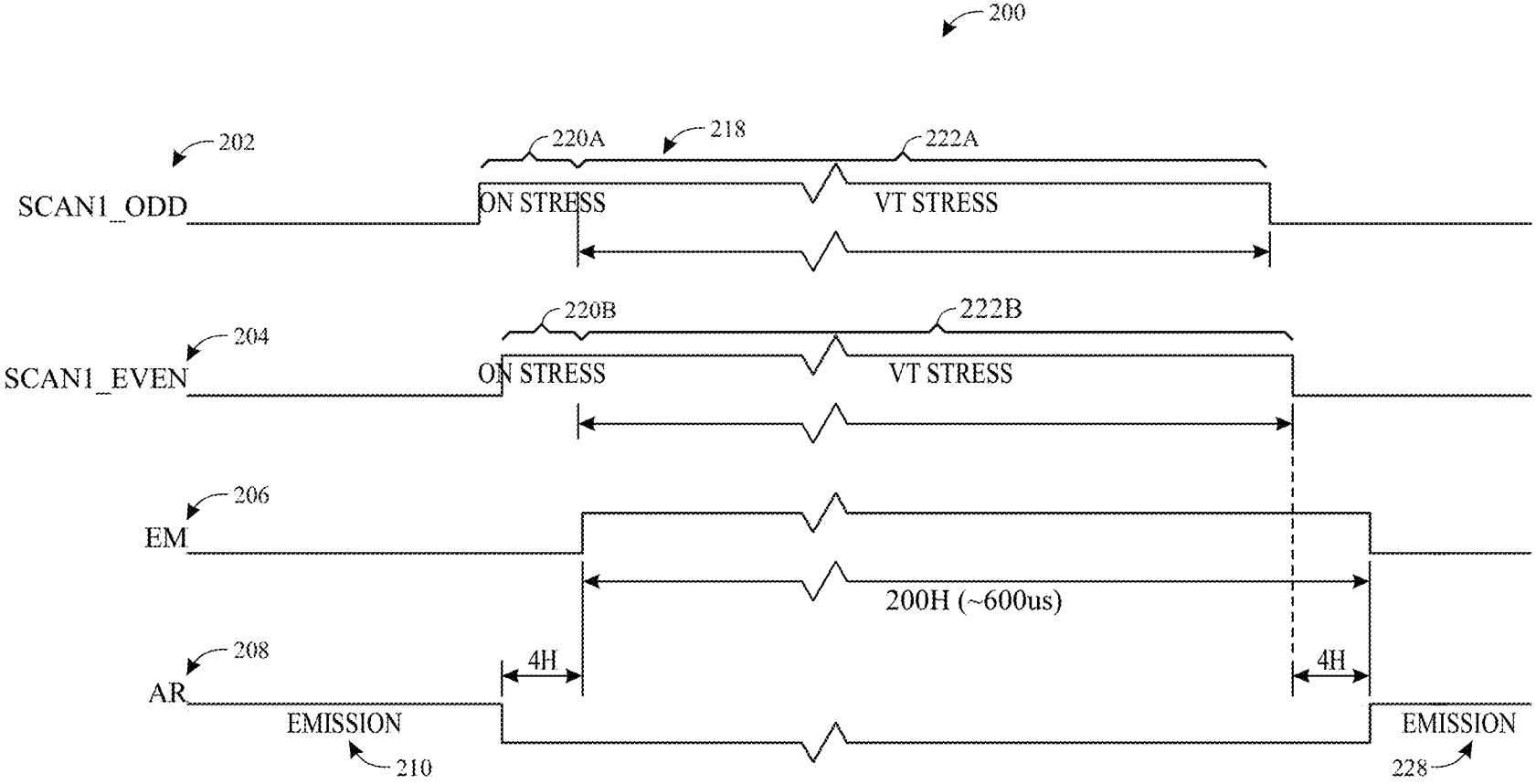
FIGS. 13-16 each illustrate a circuit timing diagram for performing in-frame cleaning, programming image data, and emitting light, in accordance with an embodiment.

Continuing with the discussion of in-frame cleaning, FIG. 12 is a flow diagram of a process 180 for operating pixel circuitry. The process 180 may be performed by the electronic device 10. More specifically, the process 180 may be performed utilizing the electronic display panel circuitry depicted in FIG. 5, which may include the pixel driving circuit 90 shown in FIG. 8. For example, the controller 69 may execute instructions stored in the local memory 14 or the main memory storage device 16 to cause the gate driver IC 72 and/or source driver IC 70 to send signals to cause the operations discussed below to occur.

At process block 182, the controller 69 may cause in-frame cleaning to be performed. As will be discussed below, performing in-frame-cleaning may entail causing a gate-to-source voltage associated with the transistor 100 to shift in a content-dependent manner. In other words, the resulting gate-to-source voltage may be dependent upon the image data (e.g., a gray-level associated with content) previously programmed onto the pixel driving circuit 90 and/or image data about to be programmed onto the pixel driving circuit 90. For example, the gate-to-source voltage applied during in-frame cleaning differs from the gate-to-source voltage present during programming of the pixel driving circuit 90.

At process block 184, the controller 69 may cause image data to be programmed on the pixel driving circuit 90. For example, the controller 69 may cause the source driver IC 70 to send a signal to cause image date to be programmed onto the pixel driving circuit 90.

At process block 186, the controller 69 may cause the OLED 92 of the pixel driving circuit 90 to emit light. For example, as discussed below, the controller 69 may send signals that cause the OLED 92 to emit light in accordance with the image data associated with the programming performed at process block 184.

It should be noted that the process 180 may repeated. For example, in some embodiments, the process 180 may be performed for each frame of image data. In other embodiments, the process 180 may be performed based on a refresh rate associated with the electronic display 18. For example, if the electronic display 18 has a refresh rate of sixty hertz, the process 180 may be performed sixty times per second. In general, performing the process 180 (e.g., performing in-frame cleaning) on displays 18 with relatively higher refresh rates (e.g., sixty hertz, 120 hertz, or greater than 120 hertz) may result in less changes in luminance compared to displays 18 with relatively lower refresh rates (e.g., 30 hertz or less than 30 hertz) because the in-frame cleaning may be performed more frequently, thus causing less charge accumulation associated with maintaining a gate-to-source voltage similar or equal to a gate-to-source voltage experienced during programming and/or once the pixel driving circuit 90 is programmed.

FIGS. 13-16 each illustrate circuit timing diagrams that may be utilized with the pixel driving circuit 90 to perform in-frame cleaning, programming, and emitting in accordance with the process 180. For example, FIG. 13 includes a circuit timing diagram 200, which includes signals 202, 204, 206, 208. The signal 202 is representative of signals on odd scan lines, signal 204 is representative of signals on even scan lines, signal 206 is representative of an emission signal (e.g., EM in FIG. 8), and signal 208 is representative of an anode reset signal (e.g., AR in FIG. 8). It should be noted that the signal 206 may be presented in an inverse manner (e.g., low state is indicative of emission being possible (based on the status of other signals)). The circuit timing diagram 200 begins during a first emission period 210, which may end upon stress 218 (more specifically, an on stress 220A) being applied to odd scan lines or, for pixels associated with even scan lines, when an on stress 220B is applied to even scan lines and when an anode reset signal is no longer being sent (e.g., as indicated by the signal 208). At a later time, the status of the emission signal 206 is modified (e.g., ceased to be sent), and a threshold voltage stress 222 is applied to the scan lines (e.g., scan lines in FIG. 8) as indicated by the signals 202, 204. In general, the on stress 220 and the threshold voltage stress 222 are stresses that can be sent to account for changes to pixel circuitry (e.g., pixel driving circuit 90) that may respectively occur when the pixel circuitry switches to an on state and from programming a threshold voltage onto a transistor, such as the transistor 100. During the on stress 220 and threshold voltage stress 222 periods, the gate-to-source voltage associated with the transistor may change from a gate-to-source voltage that is associated with the transistor when programmed. In some cases, such as for relatively high gray-levels or relatively low gray-levels, the gate-to-source voltage associated with in-frame cleaning may generally be generally similar to a programming voltage associated with a generally inverse gray-level. For example, if the gate-to-source voltage associated with the transistor 100, when programmed, has a first voltage associated with a relatively low gray-level, as a result of the on stress 220 and threshold voltage stress 222, the transistor 100 may experience a gate-to-source voltage that is typically experienced with relatively high gray-levels. In other words, the gate-to-source voltage experience due to stress being applied is content dependent.

Programming of the pixel driving circuit 90 may occur near the end of the threshold voltage stress 222 being applied or after the threshold voltage stress is no longer applied but before the signals 206, 208 change state. That is, as discussed above, programming occurs before emission. During programming, the gate-to-source voltage associated with the transistor 100 may shift to a voltage that is associated with image data that is programmed into the pixel driving circuit 90. For example, if the image data is associated with a high gray-level, one gate-to-source voltage may be applied to program the pixel driving circuit 90. In a range of potential gate-to-source voltages that may be associated with the transistor (e.g., a range from a first voltage associated with very low gray-levels to a second voltage associated with very high gray-levels), such a voltage may be in the opposite part of the range as compared to a voltage experienced during in-frame cleaning. By applying a different voltage during in-frame cleaning, the likelihood of accumulation that can cause shifts to the threshold gate-to-source voltage of the transistor 100 is vastly reduced. For example, by utilizing in-frame cleaning, any changes to the threshold gate-to-source voltage may produce changes in luminance that are undetectable or otherwise invisible to the human eye. Furthermore, after programming, another emission period 228 may occur (e.g., as indicated by activation of the signals 206, 208).

Figure 14:
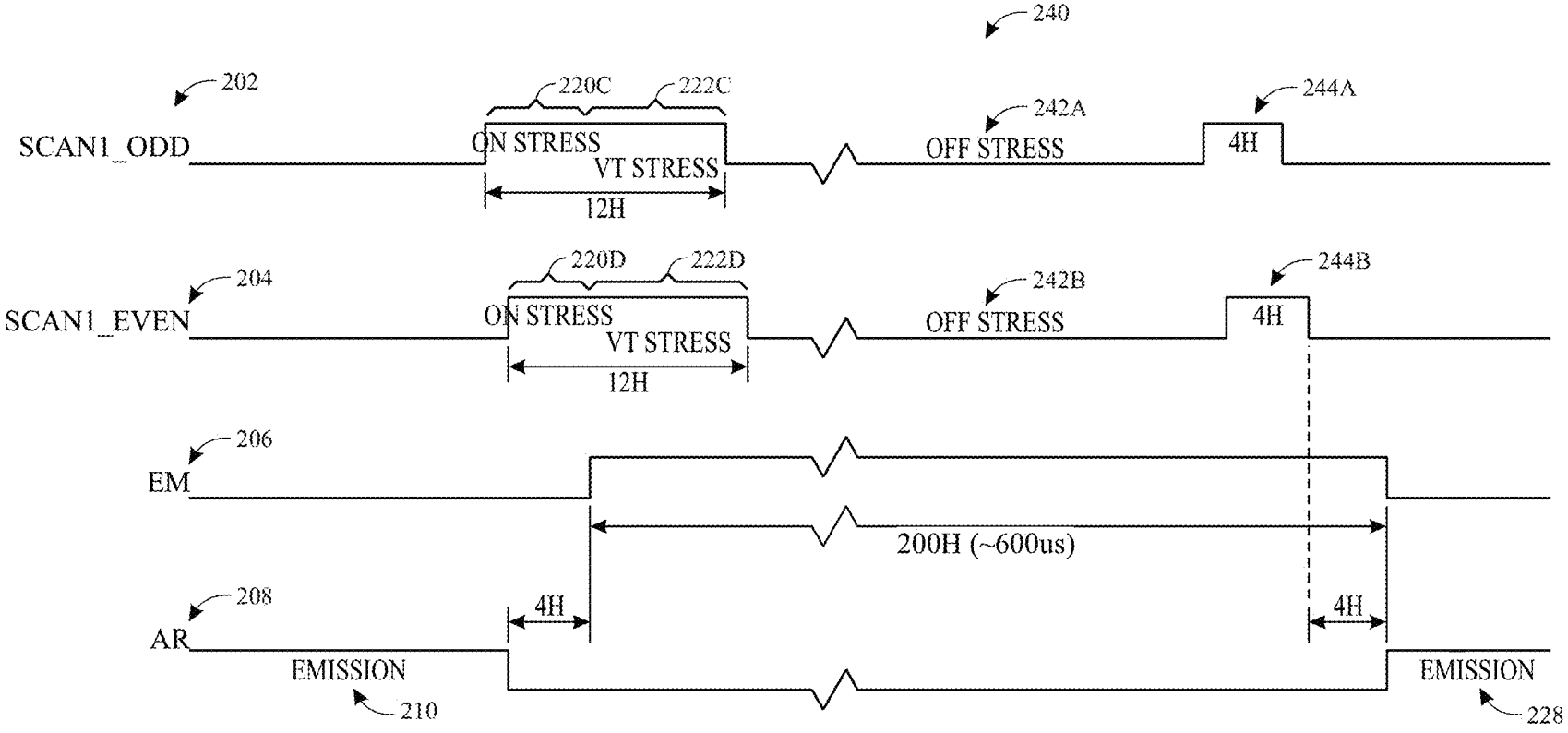

Continuing with the drawings, FIG. 14 shows a circuit timing diagram 240 of another embodiment for performing in-frame cleaning. The circuit timing diagram 240 is generally similar to the circuit timing diagram 200 of FIG. 13, but differs in several aspects. For example, as illustrated, an on stress 220 and threshold voltage stress 222 may be applied, but the threshold voltage stress 222 may generally be shorter in duration compared to the threshold voltage stress 222 of FIG. 13. Furthermore, an off stress 242 may be applied (e.g., after the threshold voltage stress 222). Similar to the on stress 220 and the threshold voltage stress 222, the off stress 242 may be applied to account for changes to the transistor 100 (e.g., changes that occur from ceasing to send a signal via one or more scan lines). Additionally, a second signal 244 may be sent to cause programming of pixel circuitry prior to emission.

Figure 15:
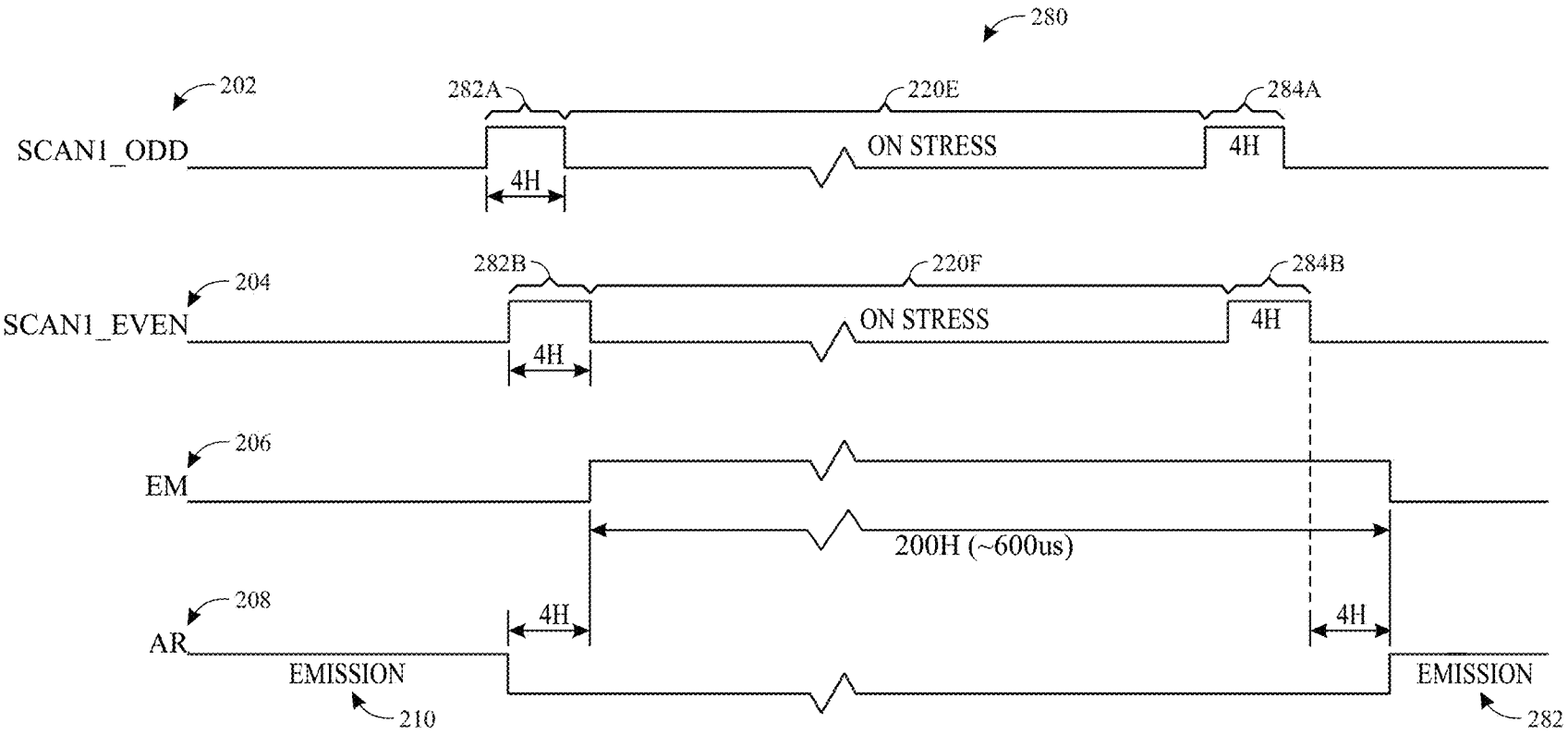

FIG. 15 depicts a circuit timing diagram 280 of another embodiment for performing in-frame cleaning. The circuit timing diagram is generally similar to the circuit timing diagram 240 of FIG. 14, but differs in several aspects. In particular, a first scan line signal 282, may be sent but may have a shorter duration than the combined duration of the on stress 220 and threshold voltage stress 222 of FIG. 14. However, as depicted in FIG. 15, an on stress 220 may be applied. Furthermore, a second scan line signal 284 may be sent to cause programming of pixel circuitry prior to emission, which may occur after the second scan line signal 284 as indicated by the signals 206, 208.

Figure 16:
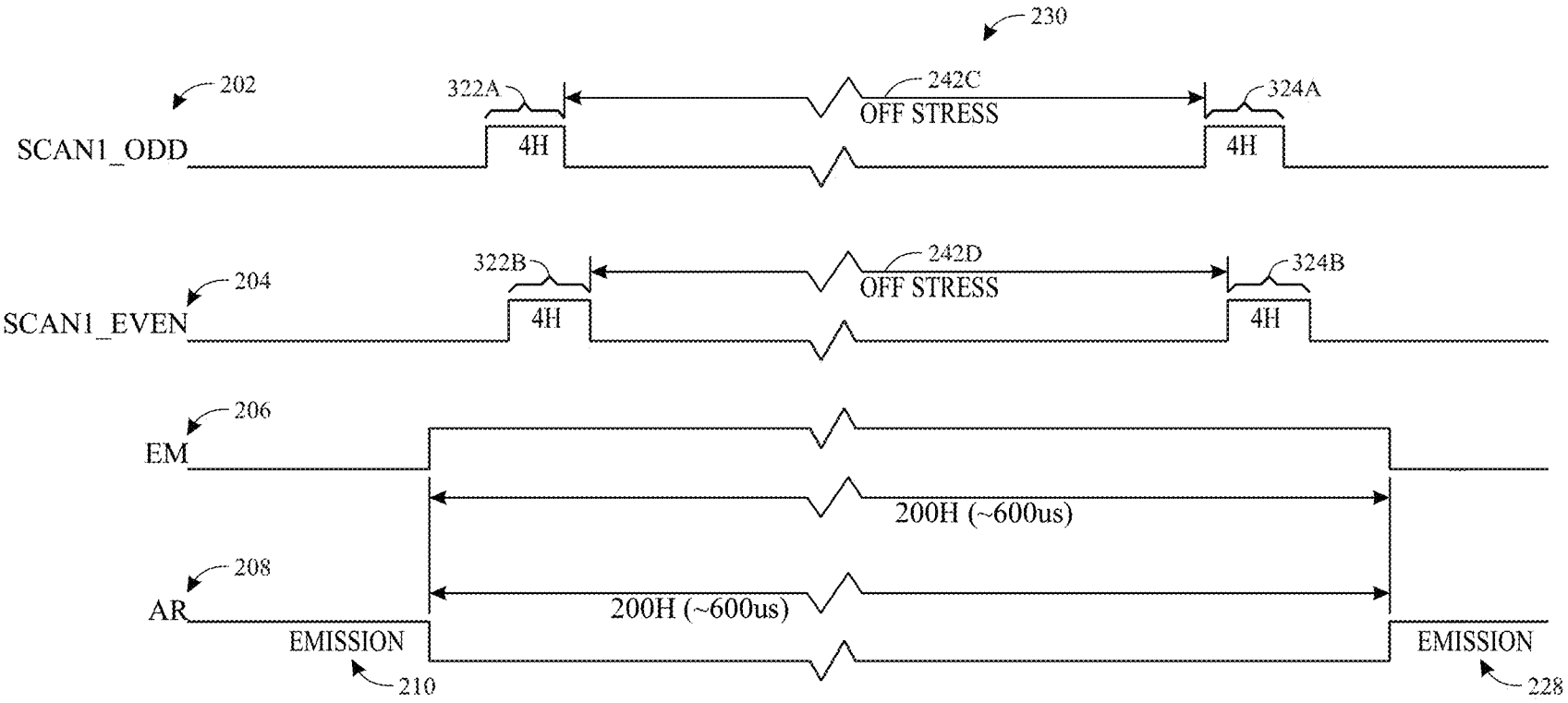

FIG. 16 depicts a circuit timing diagram 320 of another embodiment for performing in-frame cleaning. In general, the circuit timing diagram 320 is generally similar to the circuit timing diagram 280 of FIG. 15, but differs in several aspects. For example, while scan signals 322, 324 generally correspond to the scan line signals 282, 284 of the circuit timing diagram 280, an off stress 242 is applied rather between the scan line signals 322, 324 instead of an on stress 220. Furthermore, emission signal 206 may be terminated earlier (e.g., at the same time as the anode reset signal 208). The second scan line signal 324 may be send to cause programming of the transistor 100 prior to emission.

Figure 17:
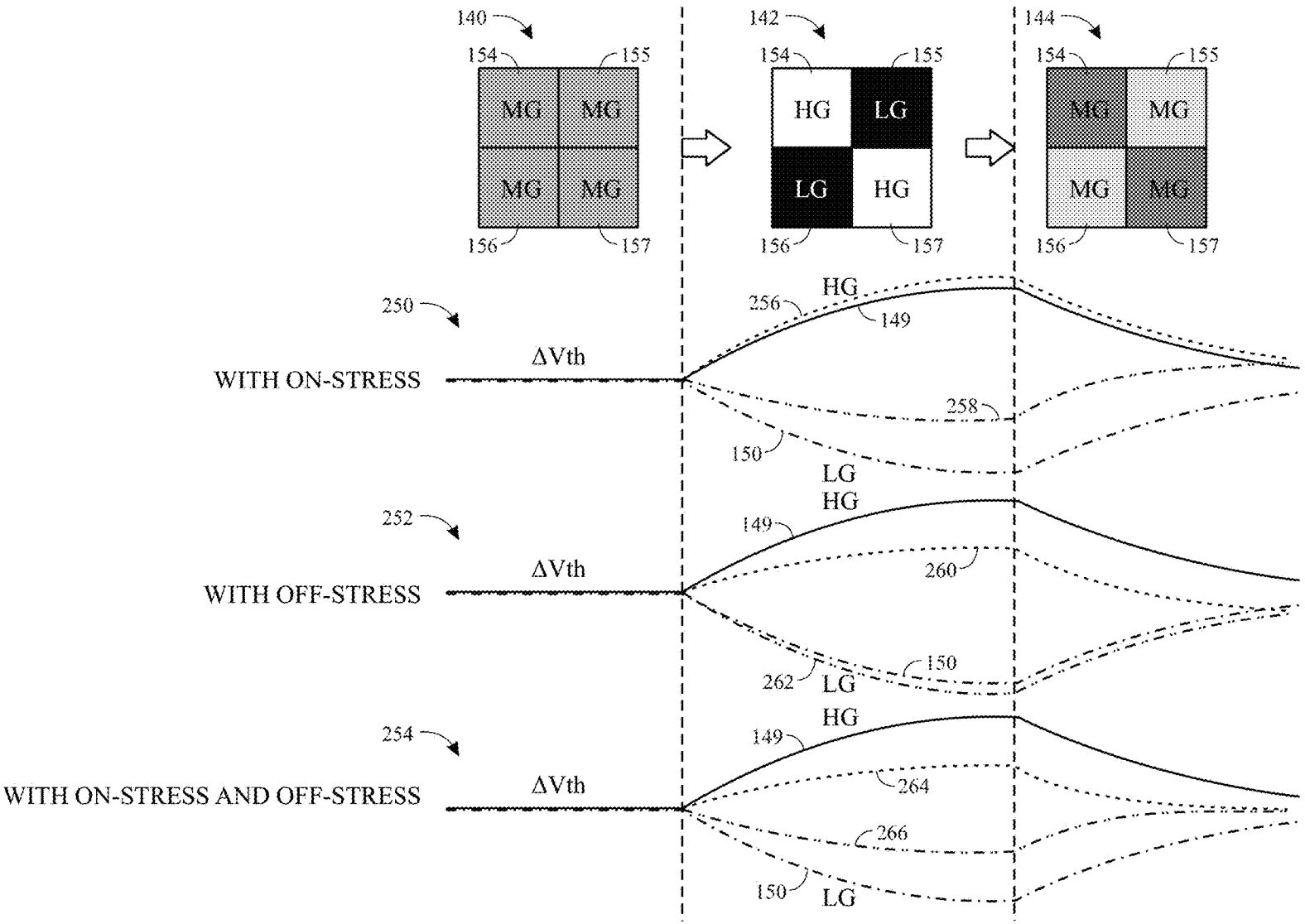
FIG. 17 illustrates three graphs showing effects on threshold voltage of utilizing in-frame cleaning, in accordance with an embodiment.

FIG. 17 illustrates three graphs showing the effect on threshold voltage of utilizing various embodiments of in-frame cleaning discussed above. In particular, FIG. 17 includes graph 250, graph 252, and graph 254, each of which illustrate threshold voltage during a transition from a first frame of content 140 to a second frame of content 142 to a third frame of content 142 relative to threshold voltage that may occur when in-frame cleaning is not performed. For example, as discussed above, line 149 is representative of a threshold voltage of transistors (e.g., transistor 100) of the first pixel 154 and the fourth pixel 157, while line 150 is representative of threshold voltage associated with transistors of the second pixel 155 and the third pixel 156. Additionally, it should be noted that the shading of the third frame of content 144 is indicative of when in-frame cleaning is not performed.

The graph 250 is associated with when an on-stress bias is utilized. A line 256 represents threshold voltage associated with the first pixel 154 and the fourth pixel 157, and a line 258 is representative of threshold voltage associated with transistors of the second pixel 155 and the third pixel 156. As illustrated, relative to the lines 149, 150, there is a smaller gap between the lines 256, 258.

The graph 252 is associated with when an off-stress bias is utilized. A line 260 represents threshold voltage associated with the first pixel 154 and the fourth pixel 157, and a line 262 is representative of threshold voltage associated with the second pixel 155 and the third pixel 156. As illustrated, relative to the lines 149, 150, there is a smaller gap between the lines 256, 258.

The graph 252 is associated with when both an on-stress and off-stress are utilized. A line 264 represents threshold voltage associated with the first pixel 154 and the fourth pixel 157, and a line 266 is representative of threshold voltage associated the second pixel 155 and the third pixel 156. As illustrated, relative to the lines 149, 150, there is a smaller gap between the lines 256, 258. Accordingly, each of the graphs 250, 252, 254 demonstrate that performing in-frame cleaning reduces a gap in threshold voltage. As discussed above, by reducing a gap in threshold voltage (or the rate at which such a gap forms), a quicker recovery from the gap in threshold voltage may occur when different content is to be presented. A faster recovery from the gap in threshold voltage enables content that more closely corresponds to image data to be displayed earlier, which may reduce the occurrence of and/or eliminate image sticking and/or perceivable image artifacts.

Each of the illustrated embodiments for performing in-frame cleaning may result in the achieved technical effects described above. For example, the formation of drifts or gaps in threshold voltage (e.g., associated with a transistor in pixel circuitry) may be greatly reduced and/or eliminated by performing in-frame cleaning when content is shown for extended periods of time (e.g., minutes, hours, days). Moreover, when content is displayed after other content has been presented for an extended period of time, a gap in threshold voltage may be more quickly reduced. By reducing the rate at which gaps in threshold voltage occur and by accelerating the rate at which gaps in threshold voltage are closed, changes in luminance perceivable by the human eye that may result from changes in threshold voltage may be reduced and/or eliminated. In particular, the in-frame cleaning techniques described herein may cause a gate-to-source voltage of a transistor to be modified to a content-dependent voltage prior to being modified again during programming of a pixel, which may reduce the occurrence of accumulation in threshold voltage as well as accelerate the recovery from an accumulation in threshold voltage.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A system, comprising:

an electronic display panel comprising a plurality of pixels configured to depict frames of image data; and display driver circuitry configured to, for a first frame of image data representing first image content:

modify a gate-to-source voltage of a transistor of a first pixel of the plurality of pixels to a first gate-to-source voltage, wherein the first gate-to-source voltage is content-dependent;

after modifying the gate-to-source voltage to the first gate-to-source voltage, program the first pixel by modifying the gate-to-source voltage to a gate-to-source programming voltage based on image data associated with the first pixel from the first frame of the image data, wherein the gate-to-source programming voltage differs from the first gate-to-source voltage; and cause the plurality of pixels to emit light to display the first image content after modifying the gate-to-source voltage to the gate-to-source programming voltage.

2. The system of claim 1, wherein the transistor is configured to cause driving of a light emitting diode (LED) of the first pixel of the plurality of pixels.

3. The system of claim 1, wherein the transistor comprises a thin film transistor.

4. The system of claim 3, wherein the transistor comprises an oxide thin film transistor.

5. The system of claim 1, wherein modifying the gate-to-source voltage of the transistor of the first pixel to the first gate-to-source voltage is configured to reduce an occurrence of a shift in a threshold voltage associated with the transistor.

6. The system of claim 5, wherein modifying the gate-to-source voltage of the transistor of the first pixel to the first gate-to-source voltage is configured to more effectively reduce the occurrence of the shift in threshold voltage the higher a refresh rate associated with the electronic display panel is.

7. The system of claim 1, wherein the first gate-to-source voltage is configured to range from a second gate-to-source voltage to a third gate-to-source voltage, wherein the second gate-to-source voltage is associated with a relatively low gray-level, and the third gate-to-source voltage is associated with a relatively high gray-level.

8. The system of claim 7, wherein the gate-to-source programming voltage corresponds to the second gate-to-source voltage, and the gate-to-source first voltage corresponds to the third gate-to-source voltage.

9. The system of claim 1, wherein the electronic display panel comprises a plurality of scan lines communicatively coupled to the display driver circuitry, wherein the display driver circuitry is configured to cause a first stress to be applied to the transistor to modify the gate-to-source voltage of the transistor of the first pixel of the plurality of pixels to the first gate-to-source voltage.

10. The system of claim 9, wherein the display driver circuitry is configured to apply a second signal to a scan line of the plurality of scan lines to cause programming of the transistor prior to causing the plurality of pixels to emit light.

11. A method, comprising, for a first frame of image data representing first image content:

modifying, via display driver circuitry, a gate-to-source voltage of a transistor of a pixel of display circuitry from a first voltage to a second voltage, wherein the second voltage is content-dependent and different than the first voltage;

after modifying the gate-to-source voltage from the first voltage to the second voltage, programming, via the display driver circuitry, the pixel by modifying the gate-to-source voltage to be a third voltage, wherein the third voltage differs from the second voltage and is based on image data associated with the pixel from the first frame of the image data; and causing, via the display driver circuitry, the pixel to emit light to display the first image content after modifying the gate-to-source voltage from the second voltage to the third voltage.

12. The method of claim 11, wherein the first voltage and the third voltage are substantially equal.

13. The method of claim 11, wherein the modifying the gate-to-source voltage from the first voltage to the second voltage is configured to reduce visible changes in luminance associated with the pixel by reducing an occurrence of a change in a threshold voltage of the transistor.

14. The method of claim 11, wherein modifying the gate-to-source voltage from the first voltage to the second voltage comprises applying a voltage to a scan line included in the display circuitry.

15. A non-transitory, computer-readable medium comprising instructions that, when executed by display driver circuitry, are configured to cause the display driver circuitry to, for a first frame of image data representing image content:

modify a gate-to-source voltage of a transistor of a pixel of display circuitry from a first voltage to a second voltage, wherein the second voltage is content-dependent, different than the first voltage, and associated with a relatively low gray-level;

after modifying the gate-to-source voltage from the first voltage to the second voltage, program the pixel by causing the gate-to-source voltage to become a third voltage, wherein the third voltage differs from the second voltage, is associated with a relatively high gray-level, and is based on image data associated with the pixel from the first frame of the image data; and cause the pixel to emit light to display the image content after modifying the gate-to-source voltage from the second voltage to the third voltage.

16. The non-transitory, computer-readable medium of claim 15, wherein the instructions are configured to cause the display driver circuitry to modify the gate-to-source voltage of the transistor from the first voltage to the second voltage at a rate corresponding to a refresh rate associated with the display driver circuitry.

17. The non-transitory, computer-readable medium of claim 15, wherein the second voltage corresponds to a gray-level associated with image data of the first frame of image data.

18. The non-transitory, computer-readable medium of claim 15, wherein the instructions are configured to modify the gate-to-source voltage of the transistor from the first voltage to the second voltage by applying one or more voltage stresses to a scan line associated with the pixel prior to programming the pixel.

19. The non-transitory, computer-readable medium of claim 15, wherein modifying the gate-to-source voltage of the transistor from the first voltage to the second voltage is configured to reduce an accumulation of charge in the transistor.

20. The non-transitory, computer-readable medium of claim 15, wherein the transistor comprises a thin film transistor.

* * * * *